United States Patent [19]

Silbermintz

[11] 4,409,750

[45] Oct. 18, 1983

[54] CALENDER FORMED FROM A CUBE PUZZLE

[75] Inventor: Marvin A. Silbermintz, New York, N.Y.

[73] Assignee: Ideal Toy Corporation, Secaucus, N.J.

[21] Appl. No.: 293,902

[22] Filed: Aug. 18, 1981

[51] Int. Cl.[3] ..... G09D 3/06; A63F 9/08

[52] U.S. Cl. ..... 40/107; 273/153 S

[58] Field of Search ..... 273/153 S, 155; 40/107, 40/111

[56] References Cited

U.S. PATENT DOCUMENTS 1,518,889 12/1924 Wooster ..... 273/153 S

FOREIGN PATENT DOCUMENTS 170062 12/1977 Hungary ..... 273/153 S 55-3956 1/1980 Japan ..... 273/153 S

OTHER PUBLICATIONS

"Metamagical Themas", by Douglas R. Hofstadter, Scientific American, Mar. 1981, pp. 20–22, 25–28,30,32,35,39.

"Notes on Rubik's Magic Cube", by David Singmaster, published by Enslow Publishers, Hillside, N.J., copyright 1981, p. 38, lines 17–23, relied on.

*Primary Examiner*—Anton O. Oechsle

*Attorney, Agent, or Firm*—Richard M. Rabkin

[57] ABSTRACT

A cube puzzle is disclosed having a plurality of small cubies operatively interconnected to permit manipulation of the cubies and movement thereof from face to face of the cube and into different positions on the cube without disassembly of the cubies. Each cubie has at least one exposed face forming a portion of the surface of the cube, and legible indicia on at least some of the cubie faces are provided. The indicia are arranged in a predetermined relation on the cubies, whereby manipulation of the cube by the user will result in the display of any one of a plurality of predetermined messages on at least one face of the cube. A calender formed from such a cube puzzle has indicia so disposed on selected cubie faces that the date, month abbreviation and name of any day in a year may be displayed on a face of the cube puzzle by proper manipulation thereof.

15 Claims, 28 Drawing Figures

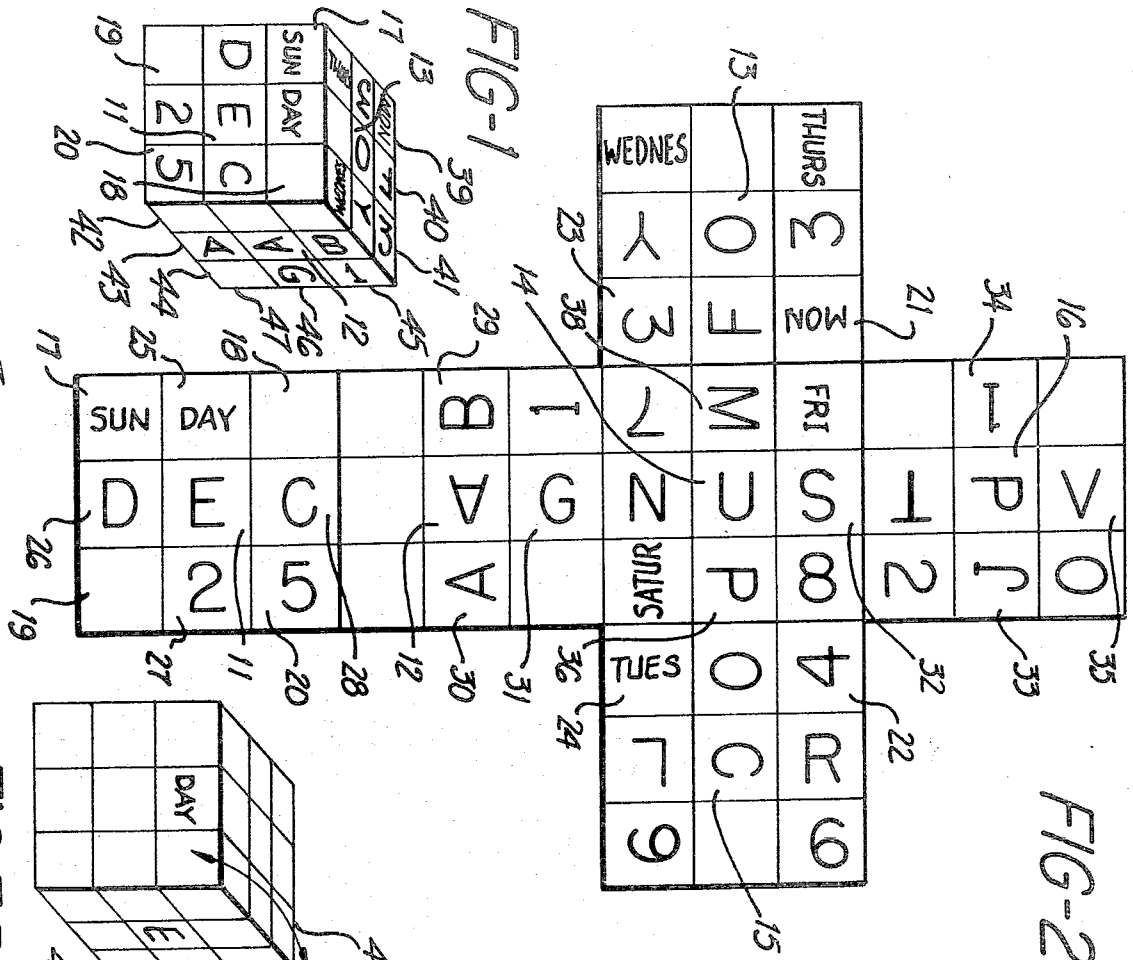
FIG-2
FIG-1
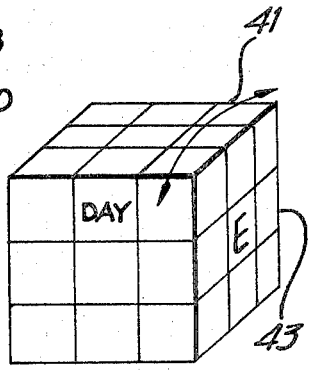
FIG-3B
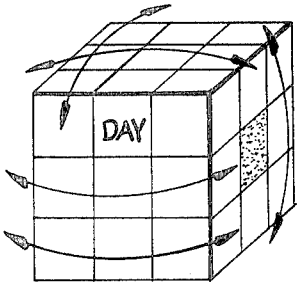
FIG-3A
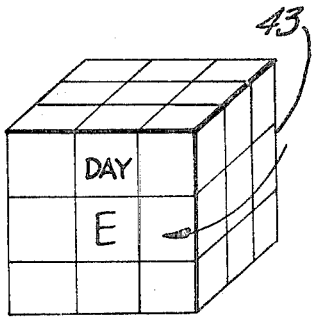
FIG-3C

CALENDER FORMED FROM A CUBE PUZZLE

The present invention relates to cube puzzles, and more in particular to a cube puzzle adapted to display predetermined messages on at least one of its cube faces.

Within the past year, a novel puzzle device has become highly popular and a phenomenal commercial success. This puzzle device is a cube puzzle, which in one embodiment is sold by the Ideal Toy Corporation under the trademark "Rubik's Cube". In other embodiments the puzzle is sold under names such as "Wonderful Puzzler", "The Cube", and "Magic Puzzle". The puzzle was apparently originally developed by one Erno Rubik, a Hungarian professor of architecture.

The devlopment of the cube as well as its structure is described in detail in the March 1981 edition of the magazine *Scientific American.*

Basically, the cube consists of three layers of smaller cubes, also known as "cubies". The cubies define six faces of the main cube having nine cubie faces on each large cube face. Any of the resulting six, 3×3 cubie faces can rotate about the center of the cube, on an axis perpendicular to the plane of the layer of the face, yet in such a way that the cube as a whole does not fall apart.

In the Ideal "Rubik's Cube" version of the cube puzzle, each face is colored uniformly with a distinct color, but repeated rotation of the various faces scrambles the individual cubie faces. The object of the game then is to continue to rotate the cube faces in order to return the cubies to their original position so that all sides of the cube have a solid color.

The structure of the cube puzzle is also described in detail in the *Scientific American* article. Basically, the structure of the individual cubies is arranged so that the cubies hold one another in assembled form by means of protuberances or "feet" on their interior sides which cooperate with adjacent surfaces of the cube so that the cubies do not disassemble during rotation of the side faces. In the 3×3×3 version of the cube puzzle there are six center cubies, i.e. the center cubie on each face, eight corner cubies, one at each corner of the large cube, and twelve edge cubies located between the corner cubies.

The center cubies have only one face, the edge cubies have two faces, and the corner cubies have three exposed faces.

Cube puzzles of the type sold by Ideal Toy Corporation under the trademark "Rubik's Cube", have been extremely successful commercially and in popularity, because of the difficulty and intrigue involved in solving the puzzle.

It is an object of the present invention to provide a version of the cube puzzle which permits predetermined messages to be displayed on at least one surface of the cube when the cubies thereof are manipulated properly.

Another object of the present invention is to provide a cube puzzle which can display predetermined messages.

A still further object of the present invention is to provide a calender formed from a cube puzzle which will enable the user to display the month, day, and date of any particular day of the year on at least one cube face.

The above, and other objects, features and advantages of this invention will be apparent in the following detailed description of an illustrative embodiment thereof, which is to be read in connection with the accompanying drawings wherein:

FIG. 1 is a perspective view of a cube puzzle constructed in accordance with the present invention, displaying the date Sunday, December 25 on one of its faces;

FIG. 2 is a projected plan view of the six faces of the cube shown in FIG. 1 when the cube is manipulated to show the date of Sunday, December 25;

Figure 7:
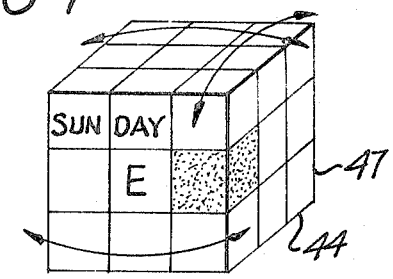

FIGS. *3a–3c* are schematic perspective views showing the manipulations of the cubie faces performed to position the letter "E" beneath the edge cubie displaying the word day, in order to present the date Sunday, December 25 on a cubie face;

FIGS. 4–26 are prespective views of the various steps to be performed in manipulating the cube puzzle in order to display on one of its faces the date Sunday, December 25 from a completely scrambled configuration for the cube.

Referring now to the drawings in detail, and initially to FIG. 1 thereof, a cube puzzle 10 constructed in accordance with the present invention, is illustrated. This cube puzzle is constructed mechanically in accordance with known principles and configurations. In particular, the puzzle may be constructed as a puzzle sold by the Ideal Toy Corporation under the trademark "Rubik's Cube", and also as described in detail in the above-mentioned *Scientific American* article. Thus, it is believed that it is not necessary in this description to describe the mechanical details of the puzzle.

Basically, the cube puzzle consists of 26 individual cubies or cube-like elements, cooperatively interconnected to define the larger six sided cube shown in FIG. 1. As mentioned, the cube includes six center cubies 11–16; eight corner cubies having three faces each (17–24); and twelve edge cubies 25–34, 36 and 38. It is noted that for convenience, the reference numerals identifying the respective cubies have been illustrated with circles around them to indicate that these reference numerals do not appear in the actual product, and to distinguish these reference numerals from the indicia printed on the various cubie faces as described hereinafter. In the expanded plan view of FIG. 2, certain of the cubies have duplicate numbers, for example, to identify the multiple faces of the edge and corner cubies.

As described in the above-mentioned *Scientific American* game, the cubies define the various faces of the cube, as well as vertical and horizontal layers 39–47, each of which can be rotated about a central axis of the cube perpendicular to the plane of the layer. By rotating these various layers or faces of the cube, the individual cubies can be moved about the cube to various positions. Thus, corner cubie can be moved to any of the other corners of the cube, and can be positioned in any one of those corners in any of three individual positions so that any one of its faces may be presented to a particular side of the cube.

In accordance with the present invention, indicia are placed on at least some of the faces of some of the cubies, in a predetermined relation to one another, so that by manipulating the cube layers or faces properly, a plurality of individual messages can be displayed on at least one cube face.

In the presently preferred embodiment illustrated in FIGS. 1 and 2, the indicia are arranged to enable the display of the day, month (in abbreviated form), and date of each day of the year. As seen more specifically in FIG. 2, certain of the cubie faces have the prefixes "MON"; "TUES"; "WEDNES"; "THURS"; "FRI"; "SATUR"; and "SUN" printed thereon. Other of the cubie faces have the letters "A"; "A"; "B"; "C"; "C"; "D"; "E"; "F"; "G"; "J"; "L"; "M"; "N"; "O"; "O"; "P"; "P"; "R"; "S"; "T"; "U"; "V"; and "Y" printed thereon; and still other cubie faces have the numbers "1"; "1"; "2"; "2"; "3"; "3"; "4"; "5"; "6"; "7"; "8"; "9"; and "0" thereon, while still other cubie faces are blank.

This combination of prefixes, letters and numbers, with one of the cubie faces having the word "DAY" thereon, enables the operator to arrange the cubies so that the day, month and date of a particular day can be displayed on one of the cube faces. In the embodiment of the invention illustrated in FIG. 2, with the date or message "SUNDAY DEC 25" displayed on one of the cube faces, the other indicia not used to display this message will be arrayed (in one possible configuration) as shown in FIG. 2. It is believed, however, that other arrays of indicia are possible, beyond that shown in FIG. 2, which would still enable all of the days, months and dates of the days of the year to be displayed on a cube face. The solution illustrated in FIG. 2 is one solution which has been developed.

According to the embodiment of the invention shown in FIG, 2, it is seen that to display the day and date in the manner shown in FIG. 1, the word "DAY" is printed or otherwise placed on the face of an edge cubie 25, while the prefixes for the names of the days of the week are placed on corner cubies, so that they can be selectively moved into position next to the "DAY".

Likewise, the numbers "1", "2"and "3" are placed on edge cubies so that they can be moved into position in the middle of the lower layer 47 on the front face of the cube as seen in FIG. 1, to form the numbers 10–30. All of the other numbers are placed on faces of corner cubies so that they can be positioned in the place of the lower cubie 20 shown in FIG. 1, thereby enabling the player to form all of the numbers from 1–31.

The various letters used to form the abbreviations for the months of the year are placed on edge cubies, with the letters "E", "A", "C", "U", "O", and "P", which would appear in the center of the abbreviations for the various months of the year, being located in the center cubie (in this example, April is abbreviated "APR").

The remaining Figures of the drawing disclose the various steps to be performed in order to display the date "SUNDAY DEC 25" on the front face of the cube as shown in FIG. 1 from a random scrambled configuration of the cube. By following these steps, any month, day and date can be displayed on the front face of the cube by moving the appropriate cubies.

Referring more specifically to FIGS. 3–29, and initially to FIG. 3*a*, the first step is to locate the cubie with the word "DAY" on it and to turn the cube so that theword "DAY" is in the top middle position, shown in FIG. 3*a*. It will be appreciated that the back, sides, middle and bottom layers of the cubes all can be moved without disturbing the word "DAY". Regardless of the configuration of the cube, the word "DAY" will always appear on an edge cubie, and the cube can be rotated so that it appears in the upper layer of the cube.

To form the abbreviation "DEC", the operator then locates the letter "E" (which is on a center cubie) and moves it around until it is in the center of the right side of the cubie with respect to the front face having the word "DAY" on it, as illustrated in FIG. 3*b*. If the letter "E" is not right side up, the layer 41 can be rotated as indicated by the arrow in the drawing, until the letter is correctly aligned. Then the center layer 43 is rotated to the left, as seen in FIG. 3*c*, to present the letter "E" beneath the word "DAY".

The next step is to position the prefix for the desired day of the week.

Figure 4:
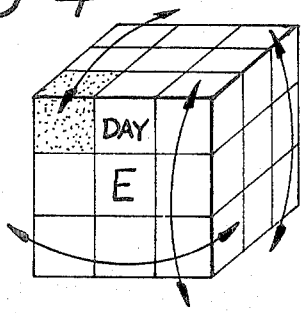

As will be seen in FIG. 4, all of the corner cubies can be rotated and moved from position to position by rotating the bottom, side, and back layers of the cube.

Figure 5:
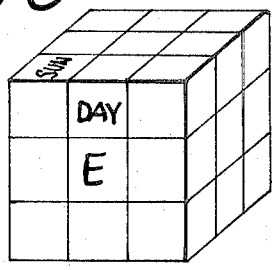
Figure 6A:
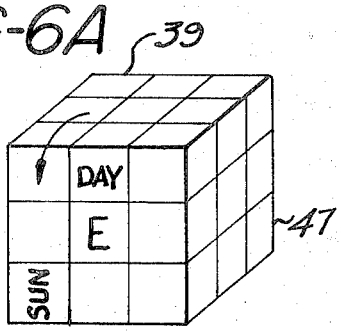
Figure 6B:
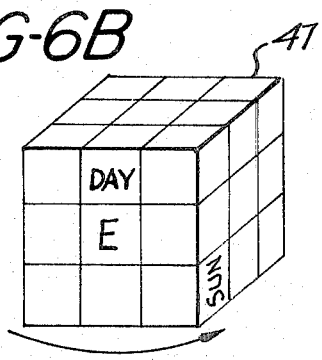
Figure 6C:
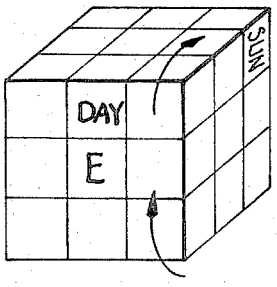
Figure 6D:
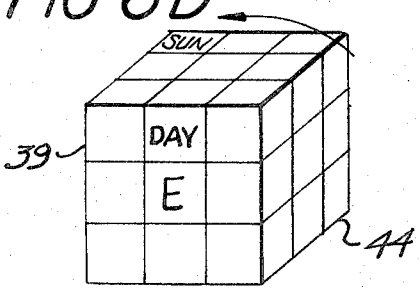
Figure 6E:
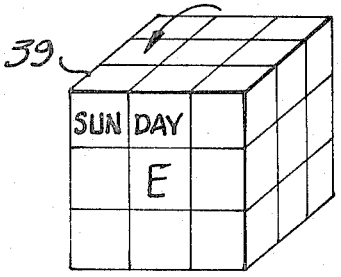

In this embodiment, since the object is to locate the prefix "SUN" next to the word "DAY", the cubie having that prefix on it is moved around the cube by rotating the various layers until it is in the top left front corner, as viewed in FIG. 6*e* of the cube. If it happens that, as a result of this manipulation, the word "SUN" is on the front face of the cube when the cubie bearing that word is in the position shown by the shaded cube in FIG. 4, then the next step may be taken. However, if the word "SUN" is on the top of that cube (as seen in FIG. 5), or on the side of the cube which is not seen in FIG. 5, it is necessary to realign the cubie while keeping it in that position. This is done by first rotating the layer 39 downwardly, through 90° as seen in FIG. 6*a*, and then rotating the bottom layer 47 to the right, as seen in FIG. 6*b*. Thereafter, the layer 47 is rotated through 180° as seen in FIG. 6*c*, to position the cubie having the prefix "SUN" in the diagonally opposite corner from its desired position. Then, the rear layer 44 of the cube is rotated through 90° as seen in FIG. 6*d*; and then the layer 39 is rotated forwardly, as seen in FIG. 6*e*, to present the prefixed "SUN" in the desired position. If the prefix "SUN" is not in the desired position after this manipulation (because, for example, it had appeared on the side of the cubie not seen in FIG. 5), a repeat of the steps shown in FIGS. 5–6*e* should present the prefix in the proper position.

With the cubie in the configuration shown in FIG. 6*e*, the layers 41, 47 and 44 can still be rotated without disturbing the day or letter "E", as shown in FIG. 7.

Figure 8A:
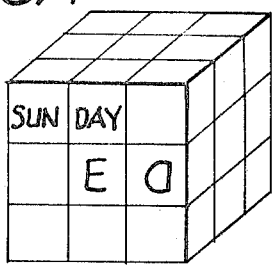
Figure 8B:
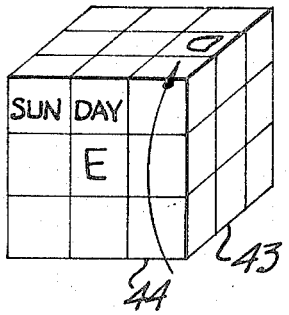
Figure 8C:
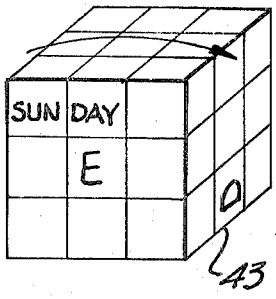
Figure 8D:
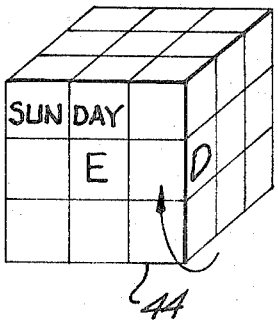
Figure 8E:
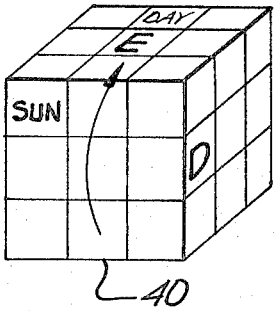
Figure 8F:
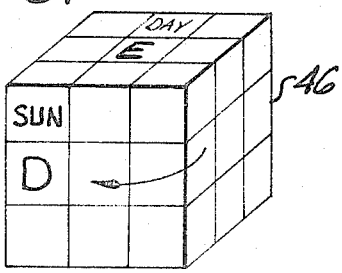
Figure 8G:
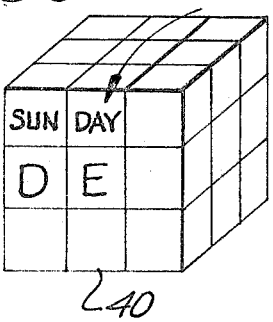

With the cube in this position, the next step would be to complete the abbreviation for the month of the year. In this example, the abbreviation "DEC" is to be formed. This can be done by locating the middle edge piece having the letter "D" on it and moving it to the middle right front position, shown by the shaded piece in FIG. 7. If the "D" is upside down, as shown in FIG. 8*a*, the following steps are performed. The layer 44 is rotated upwardly through 90° as shown in FIG. 8*b*; then the layer 43 is rotated as shown in FIG. 8*c*. With the "D" in the position shown in that figure, the layer 44 is again rotated through 90°, to the position shown in FIG. 8*d*. With the edge cubie having the letter "D" on it in this position, the center layer 40 of the cubie is rotated to displace the word "DAY" and letter "E" temporarily from the front face, as shown in FIG. 8*e*. With the cube in this position, the center layer 46 is rotated through 90° as seen in FIG. 8*f*, to position the letter "D" beneath the prefix "SUN". Thereafter, the center layer 40 is rotated back to its original position, as shown in FIG. 8*g*. Since, in the position shown by the shaded edge cubie in FIG. 7, the cube having the letter "D" on it can only occupy the configurations of FIG. 8*a* or 8*d*, it will be appreciated that once that cubie is moved into the shaded position of FIG. 7, it can be moved into the desired position by following the appropriate steps shown in FIGS. 8*a–*8*g*.

Figure 9:
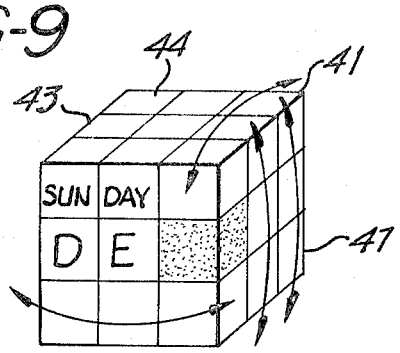

With the cubie in this configuration, as shown in FIG. 9, it is next desired to complete the abbreviation "DEC". In this configuration, the back and middle layers of the cube, as well as the layer 41 and the bottom layer 47, can all be rotated without disturbing the partial solution already achieved.

Figure 10A:
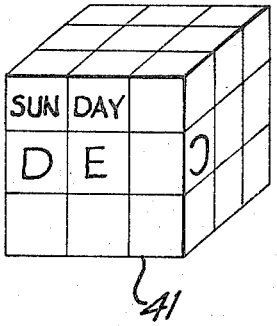
Figure 10B:
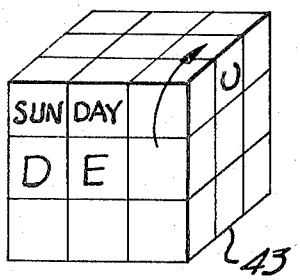
Figure 10C:
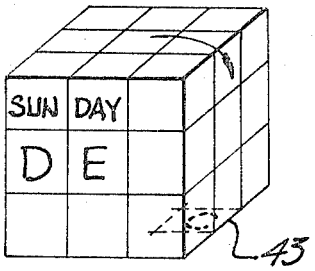
Figure 10D:
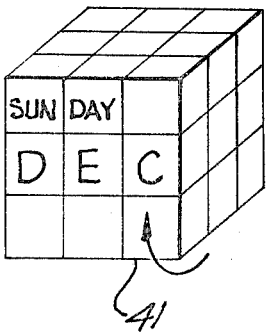

With the cube in this position, it is necessary to locate the edge cubie with the letter "C" on it and to position it in the position shown by the shaded cube in FIG. 9. Since the edge cubie with the letter "C" on it will be located in one of the movable layers of the cube because of its predetermined positioning, the player needs simply to rotate the various rotatable layers of the cube in this configuration, until the piece is in the middle right front position depicted in FIG. 9. If the "C" is right side up, this portion of the puzzle is solved. If it is not, then the "C" will be in the position shown in FIG. 10*a*. To solve the puzzle from this position, layer 41 is rotated through 90° to the position shown in FIG. 10*b*, and from that position the center layer 43 is rotated through 90°, as seen in FIG. 10*c*. In this position of the cube, the face of the cubie having the letter "C" on it will be on the bottom face of the cube. Then, by rotating the layer 41 through 90° as illustrated in FIG. 10*d*, the cubie face having the letter "C" on it will be properly positioned.

To complete the puzzle, it is necessary to move the appropriate cubies having the desired numerals on its faces, into the lower layer.

Figure 11:
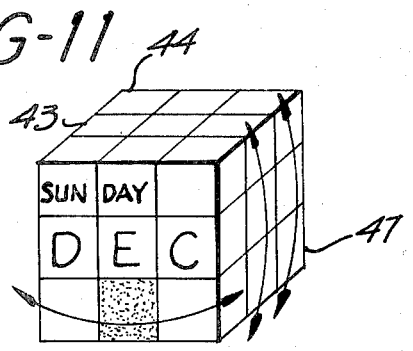

As seen in FIG. 11, with the day and month of the cube solved, the layers 43, 44 of the cubie can still be rotated without disturbing the partial solution, and the bottom layer 47 can also be rotated.

Figure 12A:
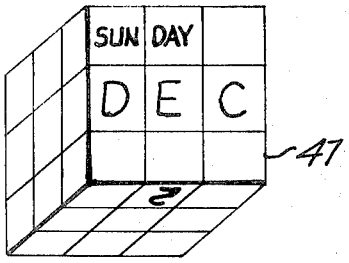
Figure 12B:
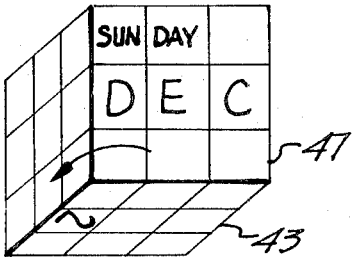
Figure 12C:
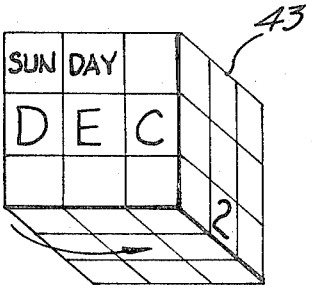
Figure 12D:
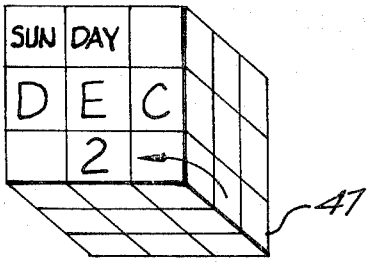

Because of the predetermined positioning of the numeral indicia on the cube faces, the numbers will be on one of the cubies within these movable layers. The first step of the solution, then, is to locate the middle edge piece with the number "2" on it, since that number must occupy the lower middle edge position shown shaded in FIG. 11. By manipulating the layers 43, 44 and 47, the edge cubie having the numeral "2" on it can be moved into the shaded cube position of FIG. 11. If after this manipulation, the numeral "2" appears in the proper upright position, this portion of the puzzle is solved. If not, then the numeral will occupy the position shown in FIG. 12*a*. To solve the puzzle from this position, the layer 47 is rotated through 90° into the position shown in FIG. 12*b*. Then, the middle layer 43 is rotated into the position shown in FIG. 12*c*. With the cube in this position, the lower layer 47 is rotated as shown in FIG. 12*d*, to position the numeral "2" beneath the letter "E" in its proper position for solving the puzzle.

Figure 13:
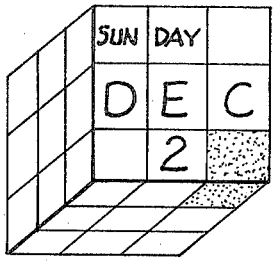

The final step in solving the puzzle is to present the numeral "5" in the shaded corner of the cube shown in FIG. 13. The cube bearing the numeral "5" may appear in any of the corners of the cube except the corner in which the cubie having the prefix "SUN" on it, appears.

Figure 14:
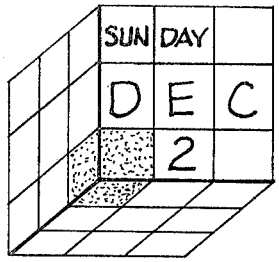
Figure 15A:
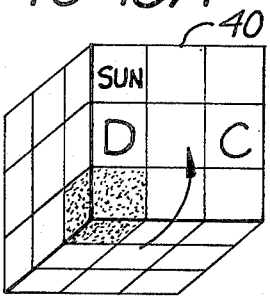
Figure 15B:
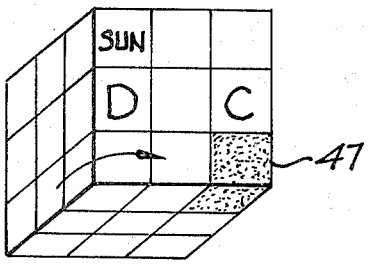
Figure 15C:
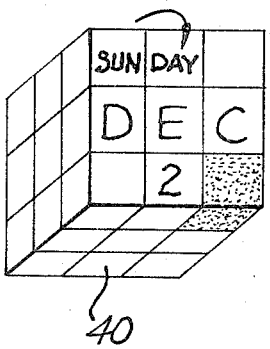

If the corner cubie having the numeral "5" on it is located in the position shown in FIG. 14, that cubie must first be moved to the lower right hand corner of the front face of the cube, as shown by shading in FIG. 13. This is done as follows. The center layer 40 of the cube is rotated upwardly as shown in FIG. 15*a*, and the lower layer 47 is then rotated 90° to the right, as shown in FIG. 15*b*. Thereafter, the center layer 40 of the cube can be returned to it original position.

Figure 16:
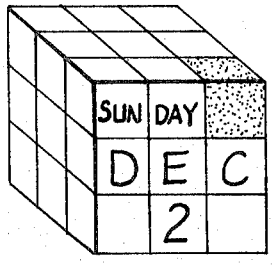
Figure 17A:
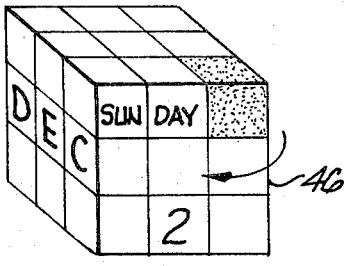
Figure 17B:
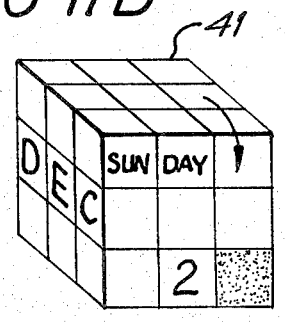
Figure 17C:
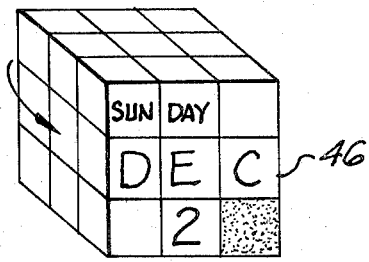

If the cube having the numeral "5" on it is in the upper right hand corner of the cube, as shown in FIG. 16, it is brought to the lower right hand corner by following the steps of FIGS. 17*a–c*. As seen therein, the center layer 46 is rotated to the right, and then the layer 41 is rotated downwardly through 90° as shown in FIG. 17*b*. Once this step is completed, the center layer 46 can be returned to its original position, as shown in FIG. 17*c*.

Figure 18:
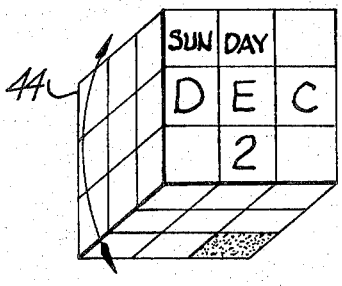
Figure 19A:
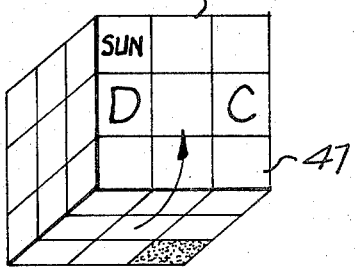
Figure 19B:
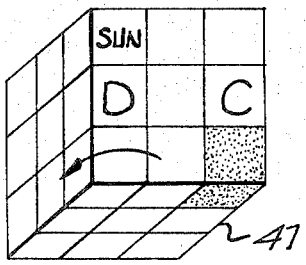
Figure 19C:
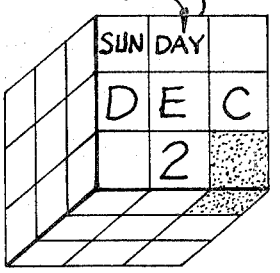

If the cubie having the numeral "5" on it is in one of the four back corners of the cubie, the back layer 44 of the cube is rotated until the desired cubie is in the lower right corner as shown by the shaded corner cubie in FIG. 18. To then properly position that cubie, the center layer 40 is rotated, as seen in FIG. 19*a*, to displace the numeral "2" and move it to the top layer of the cube. The bottom layer 47 is then rotated through 90°, as seen in FIG. 19*b*, to present the cubie bearing the numeral "5" in the lower right hand corner of the front face of the cube. The center layer 40 is then rotated back downwardly, as seen in FIG. 19*c*.

Figure 20:
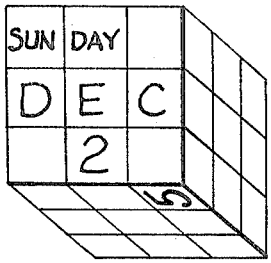
Figure 21:
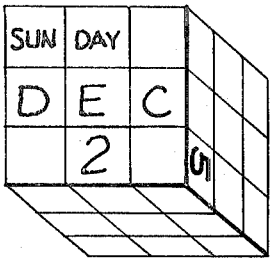
Figure 22:
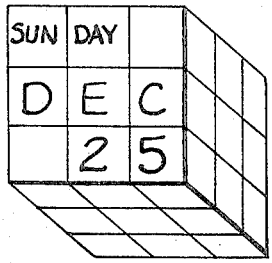

As a result of these manipulations, the cubie bearing the numeral "5" on it is now in one of the three positions shown in FIGS. 20, 21 and 22. If the cubie is in the position shown in FIG. 22 the solution is solved, unless a cubie face having some other indicia on it is located in the upper right or lower left hand corners of the cube, for which further manipulative steps become necessary to place blank cubie faces in these positions.

Figure 23A:
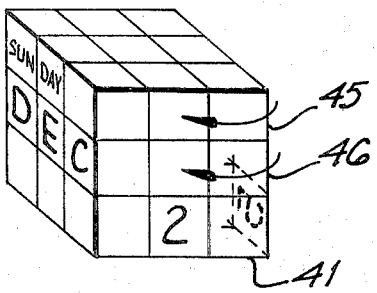
Figure 23B:
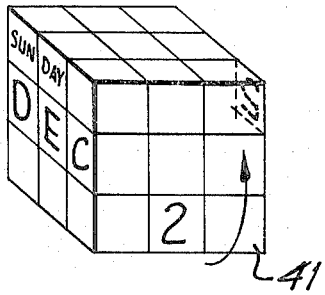
Figure 23C:
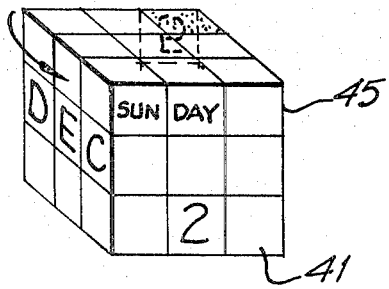
Figure 23D:
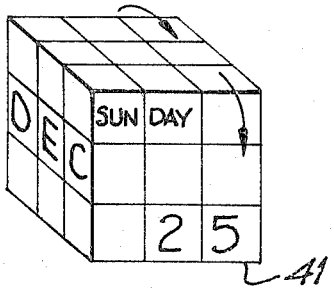
Figure 23E:
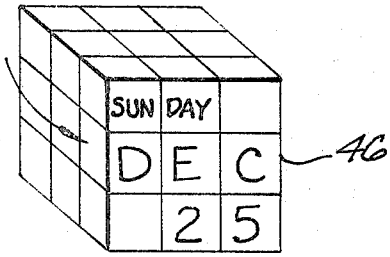
Figure 24:
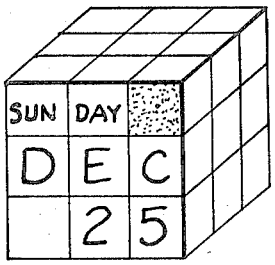

If the cubie is in the position of either FIG. 20 or 21, the following steps are performed. First, the layers 45 and 46 are rotated to the left, aseen in FIG. 23*a*. Then the layer 41 is rotated upwardly, as seen in FIG. 23*b*. The next step is to rotate the layer 45 to the right, through 90° as seen in FIG. 23*c*. This returns the day to its proper position and places the cubie having the number "5" on it at the upper rear corner. By then rotating the layer 41 downwardly through 180° as seen in FIG. 23*d*, the numeral "5" is in its proper position. Thereafter, the center layer 46 can be rotated back through 90° as seen in FIG. 23*e*. If the cubie having the number "5", now presents the numeral "5" in the position shown in FIG. 23*e*, this portion of the puzzle is solved. It is possible, however, that the numeral "5" will be on one of the other faces of the cubie after this manipulation. By repeating these steps of FIGS. 23*a–e*, the face of the cubie having the numeral "5" on it will be moved to the proper aligned position.

Figure 25A:
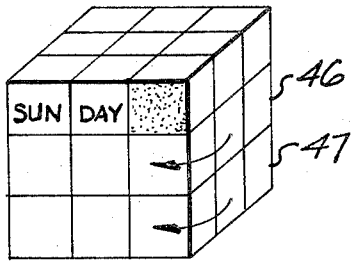
Figure 25B:
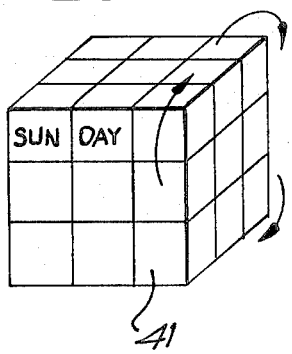
Figure 25C:
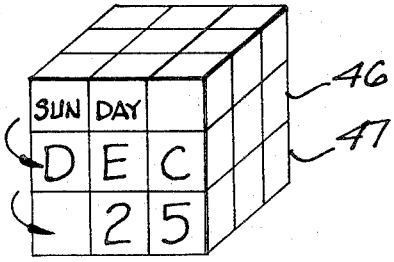

The next steps of the solution are to insure that there are blank cubie faces in the upper right hand corner and the lower left hand corner of the front face of the cube. These blanks are located on corner cubies. If there is no blank in the upper right hand corner of the cube, the first step is to rotate the layers 46 and 47 to the left, as shown in FIG. 25*a*. The layer 41 is then twisted as seen in FIG. 25*b*, until a blank cubie face appears in the upper right hand corner of the cube. When this occurs, the layers 46 and 47 can be rotated back towards the right, as seen in FIG. 25*c*.

Figure 26:
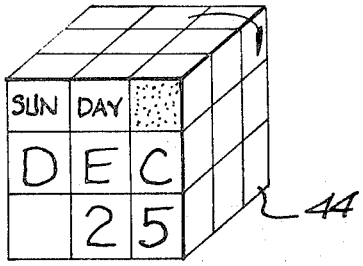

If after the step of FIG. 25*b*, it is not possible to find a blank cubie face in the layer 41 which will present itself in the upper right hand corner of the cube, the layers 46 and 47 should be returned to their original positions and the rear face 44 of the cube rotated, as seen in FIG. 26, through 90°. Then, the steps of FIGS. 25*a* and 25*b* are repeated in order to present a blank cubie face in the proper position.

When the cube is in the configuration shown in FIG. 26 with a blank cubie face in the upper right hand corner, the next step is to place a blank cubie face in the lower left hand corner. It is possible, of course, that by this time in the manipulation of the cube, there will be a blank cubie face at this location. If not, then the layers 40 and 41 are rotated through 90°. Then, the lower layer 47 of the cube is rotated until a blank cubie face is presented at the lower left hand corner of the front face cube. When that occurs, the layers 40 and 41 can be returned to their original position.

If after rotating the cubie layer 47, it is not possible to position a blank cubie face in the lower left hand front face of the cube, layers 40 and 41 are returned to their original position, and the back layer 44 is rotated through 90° in order to move a new cube into the layer 41. Then the steps described above are repeated in order to present a blank cubie face in the lower left front corner of the cube.

It will be appreciated by those skilled in the art that the manipulation of the cube in the manner described above will enable the operator to display any day, month and date on the front face of the cube. It will further be appreciated that in lieu of the day, month and date, other messages can be placed on the cube by the appropriate placement of other indicia on the cubie faces.

Although an illustrative embodiment of the present invention has been described herein with reference to the accompanying drawings, it is to be understood that the invention is not limited to that precise embodiment, and that various changes and modifications may be effected therein by those skilled in the art without departing from the scope or spirit of this invention.

What is claimed is:

1. A calendar formed from a cube puzzle comprising twenty-six individual cubies operatively interconnected to define three layers of nine cubies each, presenting fifty-four exposed cubie faces and wherein each layer of cubies is rotatable about a central axis extending perpendicularly thereto whereby the cubies may be manipulated about various faces of the cube puzzle; at least one of said cubie faces having the word "DAY" thereon; certain others of said cubie faces having the prefixes "MON"; "TUES"; "WEDNES"; "THURS"; "FRI"; "SATUR"; and "SUN" thereon respectively; certain other of said cubie faces having the letters "A"; "A"; "B"; "C"; "C"; "D"; "E"; "F"; "G"; "J"; "L"; "M"; "N"; "O"; "O"; "P"; "P"; "R"; "S"; "T"; "U"; "V"; and "Y" thereon respectively; and still other faces having the numbers "1"; "1"; "2"; "2"; "3"; "3"; "4"; "5"; "6"; "7"; "8"; "9"; and "0"; thereon respectively; and said word "DAY", prefixes, letters and numbers being arranged on said cubie faces in a predetermined relation to each other, such that the date, month abbreviation, and name of any day in a year may be displayed on a face of the cube puzzle by manipulation of said cubies.

2. The calendar as defined in claim 1 wherein said word "DAY" appears on an edge cubie.

3. The calendar as defined in claim 2 wherein said prefixes appear only on corner cubies.

4. The calendar as defined in claim 3 wherein one each of said numbers "1", "2" and "3" appears on an edge cubie and the other of said numbers "1", "2" and "3" appear on corner cubies.

5. The calendar as defined in claim 4 wherein the letters "E", "A", "O", "U", "C" and "P" appear on center cubies.

6. The calendar as defined in claim 5 wherein the letters "D"; "A"; "B"; "G"; "Y"; "F"; "M"; "N"; "P"; "S"; "L"; "O"; "R"; "T"; "J"; and "V" appear on edge cubies.

7. A calendar formed from a cube puzzle having a plurality of small cubies operatively interconnected to permit manipulation of the cubies and movement thereof from face to face forming a portion of the surface of the cube puzzle; and predetermined legible indicia on at least some of said cubie faces; said indicia being arranged in a predetermined relation on the cubies, such that the date, month abbreviation and name of any day in a year may be displayed on a face of the cube puzzle by manipulation of said cubies.

8. A calendar formed from a cube puzzle comprising twenty-six individual cubies operatively interconnected to define a cube having three layers of nine cubies each; said cubies including a first set of eight corner cubies, each having three faces and defining the corners of the cube; a second set of six center cubies, each having one face and being connected to each other to define the center cubie of each center layer of cubies in the cube; and a third set of twelve edge cubies each having two perpendicularly related faces respectively positioned between pairs of corner cubies; said cubies all being operatively connected together by means for permitting rotation of any layer of cubies lying on a common plane, to be rotated about an axis extending perpendicularly to its plane whereby the cubies can be moved by manipulation of said cube layers from face to face and position to position on said cube; and predetermined legible indicia on at least some of said cubie faces, said indicia being arranged in a predetermined relation to each other to enable the user to display the date, month abbreviation and name of any day in a year on at least one face of the cube by manipulating the cube faces to present the desired cubie faces in a desired relation on said at least one face.

9. The calendar as defined in claim 8 wherein said indicia are selected to display the month, day and date of each day of the year.

10. The calendar as defined in claim 9 wherein said indicia include the word "DAY" on one edge cubie.

11. The calendar as defined in claim 10 wherein said indicia include the prefixes "MON"; "TUES"; "WEDNES"; "THURS"; "FRI"; "SATUR"; and "SUN" on separate faces of certain of said corner cubies.

12. The calendar as defined in claim 11 wherein certain other of said cubie faces have the letters "A"; "A"; "A"; "B"; "C"; "C"; "D"; "E"; "F"; "G"; "J"; "L"; "M"; "N"; "O"; "O"; "P"; "P"; "R"; "S"; "T"; "U"; "V"; and "Y" thereon respectively; and still other faces have the numbers "1"; "1"; "2"; "2"; "3"; "3"; "4"; "5"; "6"; "7"; "8"; "9"; and "0" thereon respectively.

13. The calendar as defined in claim 12 wherein one each of said numbers "1", "2" and "3" appears on an edge cubie, and the other of said numbers "1", "2" and "3" appear on corner cubies.

14. The calendar as defined in claim 13 wherein the letters "E", "A", "O", "U", "C" and "P" appear on center cubies.

15. The calendar as defined in claim 14 wherein the letters "D"; "A"; "B"; "G"; "Y"; "F"; "M"; "N"; "P"; "S"; "L"; "C"; "O"; "R"; "T"; "J"; and "V" appear on edge cubies.

* * * * *